US006389241B1

(12) United States Patent
Cernusak et al.

(10) Patent No.: US 6,389,241 B1
(45) Date of Patent: May 14, 2002

(54) METHOD AND APPARATUS FOR HARD COPY CONTROL USING AUTOMATIC SENSING DEVICES

(75) Inventors: Nancy Cernusak, Eagle; Michael J. Martin, Boise; John W. Huffman, Meridian, all of ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/765,884

(22) Filed: Jan. 16, 2001

(51) Int. Cl.[7] ..... G03G 15/00; G03G 15/16; G03G 15/20

(52) U.S. Cl. ..... 399/44; 399/45; 399/66; 399/67

(58) Field of Search ..... 399/15, 44, 45, 399/42, 66, 67, 68, 69, 389, 46, 71

(56) References Cited

U.S. PATENT DOCUMENTS 5,138,379 A * 8/1992 Kanazashi et al. ..... 399/44
5,241,159 A * 8/1993 Chatteriee et al. ..... 219/470
5,287,154 A * 2/1994 Nakai et al. ..... 399/42
5,576,811 A * 11/1996 Kobayashi et al. ..... 399/15 X
5,585,908 A * 12/1996 Rakov et al. ..... 399/311
5,822,670 A * 10/1998 Morigami ..... 399/334
5,905,925 A * 5/1999 Kawabata et al. ..... 399/45
6,163,662 A * 12/2000 Martin et al. ..... 399/45
6,253,037 B1 * 6/2001 Park ..... 399/44

FOREIGN PATENT DOCUMENTS

JP 59-180571 * 10/1984
JP 6-83230 * 3/1994
JP 6-230700 * 8/1994

* cited by examiner

*Primary Examiner*—Joan Pendegrass

(57) ABSTRACT

An electrophotography hard copy apparatus uses automated sensing devices to provide current condition signals and operational feedback signals to optimize subsystem operational parameters. Monitoring of ambient environmental conditions, subsystem operational parameters, and a print medium from input through output and the final printed text or image for predetermined characteristics is used to generate signals indicative of conditions that can be altered by commands to the apparatus' subsystems to optimize print quality.

39 Claims, 9 Drawing Sheets

METHOD AND APPARATUS FOR HARD COPY CONTROL USING AUTOMATIC SENSING DEVICES

BACKGROUND OF THE INVENTION

1. Field of the Invention

The present invention relates generally to the fields of electrophotography and hard copy apparatus and, more specifically, to the control of printing and fixing alphanumeric text and images on print media using automatic sensing devices, feedback, and digital control techniques in a laser hard copy apparatus.

2. Description of Related Art

Basically, in electrophotography—the basic technology behind laser printing such as with Hewlett-Packard Company's HP™ LaserJet™ products—a latent image on a charged surface area of a photoconductor is developed, by application of an electroscopic toner to the area. The developed image is transferred to a hard copy medium. Both wet toner chemicals and dry toner powders are known to be used to develop an image using heat fusible toner particles. The image is then fixed, that is, fused to the print medium. (For ease of explanation, the word paper will be used as an exemplary print medium hereinafter; however, as will be recognized by a person skilled in the art, the invention described herein is applicable to all forms of hard copy media such as papers, card stock, transparencies, envelopes, and the like; the word image, or sometimes print depending on the context, is used as a generic term for all alphanumeric text, graphics, photographs, and the like; no limitation on the scope of the invention is intended nor should any be implied.)

In its basic aspects, a laser printing engine 124, shown schematically in FIG. 6 (Prior Art), applies a charge with a scorotron charger 136 to a moving photoconductive insulating surface area of a photoconductor, or photoreceptor, 126. The surface area is exposed to a pattern of light 138, 140. A latent image of the pattern is formed on the charged surface which is then developed by application of electroscopic toner 128, 130, 132, 134 (in this example, color toner) to the photoconductive material. The developed image is transferred to a hard copy medium 152 using a transfer drum 148 with a transfer corona charge unit 150 and transferred to the medium 152 by using another transfer corona unit 154. The image bearing medium 152 is then passed to the fuser 160 subsystem where the toner is fused, or fixed. The photoconductive material insulating surface is then erased 146, cleaned 142, 144, and reused for the next image. This basic construct is used in a variety of state of the art products such as computer printers and plotters, copiers and hard copy scanners, facsimile machines, multifunctional peripherals, and the like (referred to generically hereinafter as printers).

In addition to visual perception of print quality, the effectiveness or reliability of the electrophotographic process is determined in part by how well the toner image stays fixed on the media after the media exits the printing operations. Having an effective temperature in the fuser subsystem is vital to ensuring optimized image quality and achievable print. Too low of a fusing temperature can result in toner which is not properly fixed to the print media; a low strength bond between the toner and the media can cause toner to break from the media with a low degree of mechanical stress. Too high of a fusing temperature can result in melted toner adhering to the surface of the fixing device and offsetting the toner from the correct location on the print media. Either case results in undesirable print defects, often referred to as "artifacts." Variables that determine the effectiveness of the fusing process include (1) paper parameters (the major parameters including surface roughness, thickness, moisture content, chemical composition, base weight, and size), (2) environmental parameters (the major parameters including temperature and humidity of the ambient air), and (3) fuser assembly operational parameters (the major parameters including temperature, pressure, nip size, surface properties of roller, paper speed, and fuser electrical bias).

Another factor in the determination of final print quality will be the bias voltages used in various components of the printer subsystems, e.g., the transfer voltage on the image transfer roller, the charges on various electrostatic charge/discharge elements, and the like as would be known to a person skilled in the art.

In many commercially available systems, many of these parameters are neither sensed nor controlled. The solution to their individual and possibly cumulative negative effect on print quality is to over-design the system to cover worst case scenarios. For example, a fixed fuser temperature is often used, set for a "typical media" for which the printer is compatible. However, fixed fuser temperatures cannot accommodate media types that require more heat to properly fuse the toner to the special media; fixed fuser temperatures may be too high for special media; media types requiring lower fuser temperatures may be damaged, e.g., wrinkled, by the relatively high heat of a fixed temperature fuser.

Other conventional arrangements provide user controls for manually adjusting operational parameters. Typically, such manual adjustments are made after print problems are already occurring; thus, print monitoring is required for prompt attention.

In co-pending applications, the common assignee has provided some specific, advanced solutions:

U.S. Pat. No. 6,011,939, based on Ser. No. 09/126,628, filed by co-inventor Martin on Jul. 30,1998, addresses SENSING PRINT MEDIA SIZE TO TEMPERATURE CONTROL A MULTI-HEATING ELEMENT FIXING DEVICE by relating media size to given print data;

U.S. Pat. Appl. Ser. No. 09/348,650, filed by co-inventor Martin et al., on Jul. 6,1999, addresses IMAGE FORMING DEVICES, FUSING ASSEMBLIES AND METHODS OF FORMING AN IMAGE by monitoring media qualitative characteristics to adjust fusing parameters;

U.S. Pat. Appl. Ser. No. 09/354,638, filed by co-inventor Martin et al., on Jul. 16,1999 addresses AUTOMATIC FUSER TEMPERATURE CONTROL; sensed media vibrations are related to print media type and fuser temperature selected using the measured sympathetic response;

U.S. Pat. Appl. Ser. No. 09/384,716, filed by co-inventor Martin et al., on Aug. 26,1999, addresses issues with respect to METHOD AND APPARATUS FOR DETECTING IMAGE MEDIUM SURFACE DEFECTS IN AN IMAGING SYSTEM by monitoring the fuser subsystem pressure roller and heated roller surface conditions; and U.S. Pat. Appl. Ser. No. 09/430,356, filed by co-inventor Martin, on Oct. 28, 1999, addresses issues with respect to FIXING DEVICE CONTROL BASED UPON MEDIA TEXTURE MEASUREMENT using optical sensing; rough media requires a higher fuser temperature than smooth media.

One type of planar type fuser is shown in assignee's patent for a THERMAL TRANSFER APPARATUS FOR FUSING PRINT DYE ON A MEDIA, U.S. Pat. No. 5,541, 636, file Jun. 2, 1994 by G.B. Ingram.

There is a need for an overall system approach to detecting the necessary properties of the paper and ambient environment as the paper is being processed and using feedback information to control the printing operational parameters, automatically optimizing in real-time the processes for each media type supported by the device.

SUMMARY OF THE INVENTION

The present invention relates to a method and apparatus for controlling the fuser assembly operation by substantially continuously feeding sensor information, viz., signals indicative of fuser operating parameters, ambient environment conditions, and current copy paper characteristics and performance, to a control circuit. As media is fed into the hard copy apparatus from an input supply and throughout the printing process, a variety of detection devices determine media properties, ambient environmental conditions, and current fuser assembly operating conditions such that feedback signals are sent to the controller and real time adjustments made to fuser assembly operating conditions appropriate to optimize the fixing of an image on the next sheet as it passes through. Moreover, output print characteristic detectors can be used to provide direct print quality feedback to the controller.

In its basic aspects, the present invention provides a print fusing system, including: print fuser having a plurality of individually controllable heaters; a controller connected to said heaters; and connected to said controller, at least one sensor for ambient environmental conditions, at least one sensor for media parameters, at least one sensor for current print fuser system conditions, such that signals from each said sensor to said controller are provided to said controller for adjusting fusing system conditions to optimal for the next media sheet passing therethrough.

In another aspect, the present invention provides a hard copy apparatus, having mechanisms for applying toner to a print media sheet in a predetermined pattern and a controller for printing and media transport subsystems of the apparatus, including: connected to the controller, a toner fuser device having a plurality of individually controllable heaters for thermally fixing the toner to the sheet, at least one sensor for ambient environmental conditions, at least one sensor for media parameters, at least one sensor for current fusing system conditions, wherein signals from each said sensor are provided to said controller for adjusting fusing system conditions to optimal for the print media sheet passing therethrough.

In another aspect, the present invention provides a method for hard copy print fusing using automated sensing devices in a hard copy apparatus, including the steps of: monitoring for a set of predetermined characteristics a sheet of print media transported from an input of the hard copy apparatus to the output of the hard copy apparatus; producing a set of signals indicative of the predetermined characteristics; post-print deposition operations, running a printed sheet through a print fusing subsystem; and controlling print fusing operational parameters of said print fusing subsystem by analyzing said signals and automatically adjusting said operational parameters to an optimal set of parameters for the sheet.

In another aspect, the present invention provides a method for controlling hard copy apparatus subsystems printing operation parameters, via a hard copy apparatus controller, including the steps of: recognizing print medium characteristics during said medium input; recognizing said subsystems printing operation parameters current states; and based on said steps of recognizing print medium characteristics and recognizing said current states, commanding said subsystems to adjust printing operation parameters from said current states to adjusted states for optimizing print quality in accordance with said characteristics.

In another aspect, the present invention provides a hard copy apparatus, having mechanisms for electrophotographically processing image printing data as a printed page and mechanisms for controlling the mechanisms for electrophotographically processing image printing data, including printing and media transport subsystems thereof, including: connected to the mechanisms for controlling, at least one sensor for ambient environmental conditions, at least one sensor for media parameters and at least one sensor for print quality characteristics, wherein signals from each said sensor to said mechanisms for controlling are provided to said mechanisms for controlling for determining and adjusting operational parameters of said mechanisms for electrophotographically process image printing data to optimal levels for printing the image data on a media sheet passing through said apparatus.

In another aspect, the present invention provides a memory device having a program for controlling electrophotography device subsystems including: computer code enabling the recognition of signals indicative of print media characteristics, signals indicative of printed image characteristics, and signals indicative of current electrophotography device subsystems operational parameters; computer code determining optimal electrophotography device subsystems operational parameters based upon analysis of said signals indicative of print media characteristics and signals indicative of printed image characteristics; and computer code commanding adjustments to the electrophotography device subsystems operational parameters based upon the analysis of said signals indicative of print media characteristics and signals indicative of printed image characteristics.

Some of the advantages of the present invention are:

- it improves control of laser printer operations in real time;
- it improves fusing hard copy toner;
- it improves print quality;
- it provides automatic adjustments to printing processes across multiple print media types;
- it provides a system where no end-user interaction is required at the hard copy apparatus due to media and environment changes;
- it alleviates the necessity for print job monitoring; and
- it provides data useful in determining whether maintenance processes should be implemented.

The foregoing summary and list of advantages is not intended by the inventors to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01 (d) merely to apprise the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically annotated.

DESCRIPTION OF THE PREFERRED EMBODIMENT

Reference is made now in detail to a specific embodiment of the present invention, which illustrates the best mode presently contemplated by the inventors for practicing the invention. Alternative embodiments are also briefly described as applicable. Subtitles are used hereinafter for ease of reference; no limitation on the scope of the invention is intended nor should any be implied.

LASER-TYPE APPARATUS PRINTING

Figure 1:
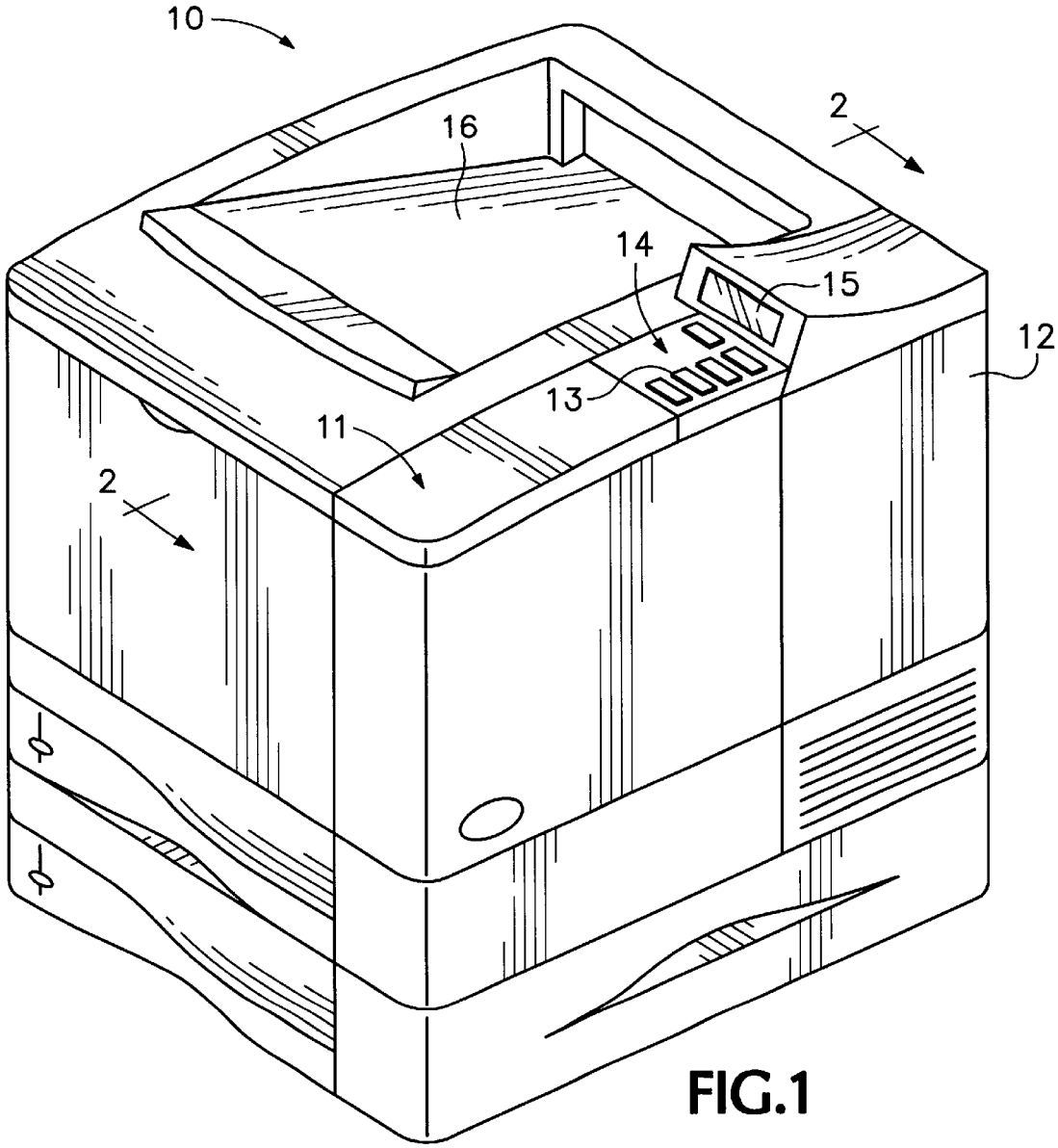
FIG. 1 is an isometric view of an exemplary image laser printer embodiment in accordance with the present invention.

FIG. 1 shows an exemplary image forming device 10 embodying the present invention. The depicted image forming device 10 comprises an electrophotographic printer. The image forming device 10 includes a housing 12 arranged to house internal components (not seen in this view, but see FIGS. 2 and 3 described hereinafter). A user interface, or input control panel, 14 is provided upon an upper surface 11 of the housing 12. The manual input control panel 14 includes a key pad 13 and a display 15. An end-user can control operations using the key pad 9 or with driver software from a computer (not shown, but see FIGS. 4 and 7 described hereinafter) connected with the image forming device 10, monitoring operations using the display 15. An outfeed tray 16 is provided for receiving printed, hard copy pages.

Figure 2:
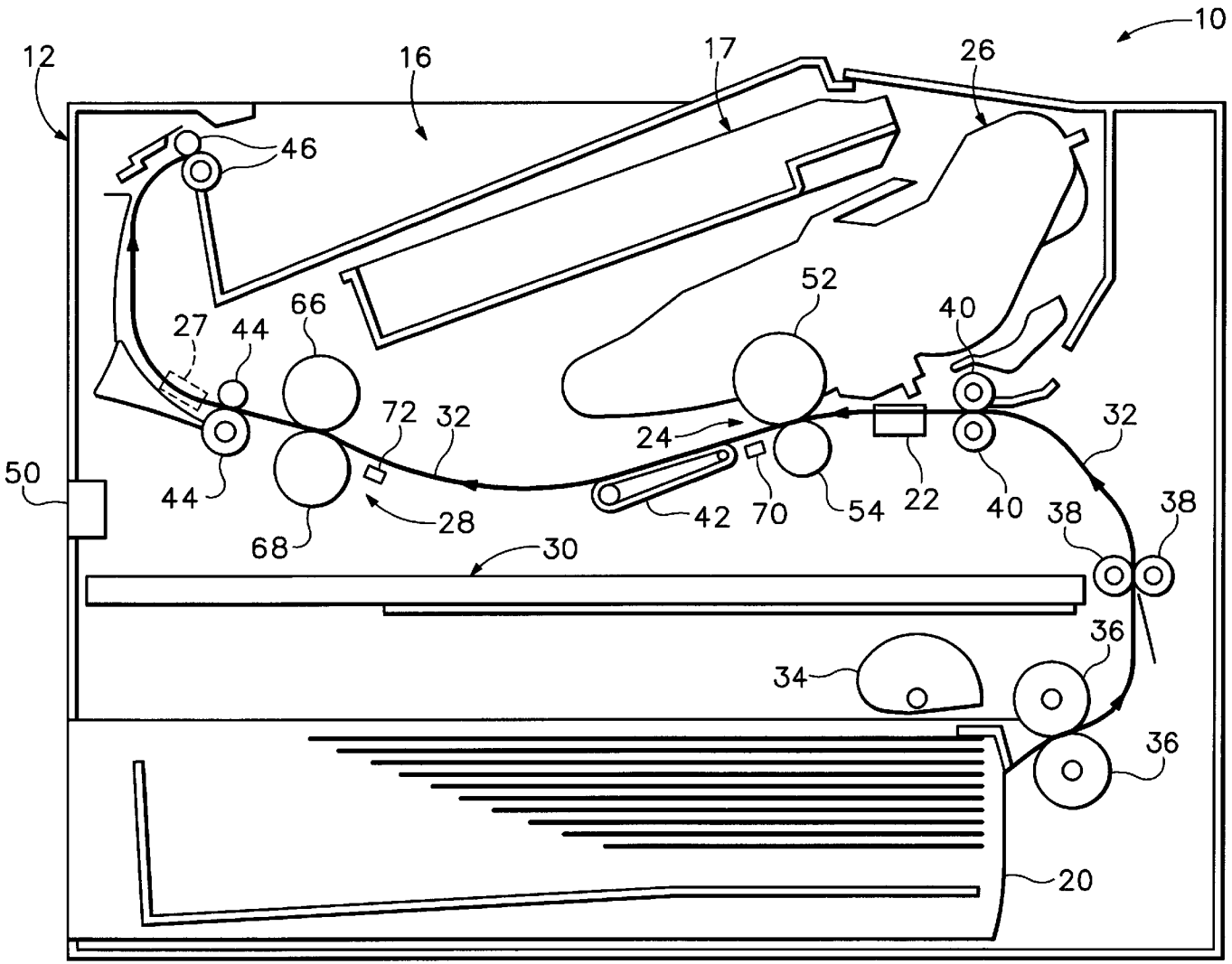
FIG. 2 is a cross-sectional view schematic illustration of the image forming device as shown in FIG. 1 taken in plane 2—2.

In accordance with the present invention, FIG. 2 is a schematic illustration in transparent view of the various internal components of the image forming device 10. The image forming device 10 includes a laser scanner 17, media supply tray 20, a representative sensor 22, an imager 24, a developing 26 subassembly, a fuser 28 subassembly, and a controller 30. A media path, represented by multi-headed arrow 32, is provided through the device 10. Rollers are provided along the media path 32 to guide media in a "downstream" direction from the media supply tray 20 towards the outfeed tray 16. More specifically, a pick roller 34, feed rollers 36, transport rollers 38, registration rollers 40, a roller driven conveyor 42, delivery rollers 44, and output rollers 46 are arranged in succession to transport and guide media along the media path 32.

The image forming device 10 includes an input device 50 configured to receive an image in a printer configuration, namely a port coupled to the controller 30; an exemplary input device 50 includes a parallel connection coupled with an associated computer or network (neither shown). Such a computer or network generally provides digital files (e.g., page description language (PDL) files) corresponding to an image to be produced within the image forming device 10.

Developing subassembly 26 is positioned adjacent the media path 32 and provides developing material, such as toner, for forming the images. The developing assembly 26 is preferably implemented as a disposable cartridge.

An exemplary sensor 22 is positioned to determine a qualitative characteristic of the apparatus or media. Further description of a plurality of such sensors is given hereinafter with respect to FIGS. 4–8.

The imager 24 subassembly, including developing assembly 26, is positioned adjacent the media path 32 and transfers toner material appropriately onto the media passing, corresponding to the data received via the input 50. The fuser 28 subassembly is adjacent the media path 32 and is located downstream from the imager 24 subassembly. The fuser 28 fuses the developing material with the media.

Exemplary electrostatic brushes 70, 72 are provided at various locations of the apparatus. One electrically bias-controlled brush 70 is provided to discharge the imaging roller 52. Another electrostatic brush in contact with the media sheet in media path 32 is used to bias the media sheet upstream of the fuser 28. It is also known to use such brushes (not shown) to discharge the fuser roller 66 and the media sheet 18 downstream of the fuser 28.

Figure 3:
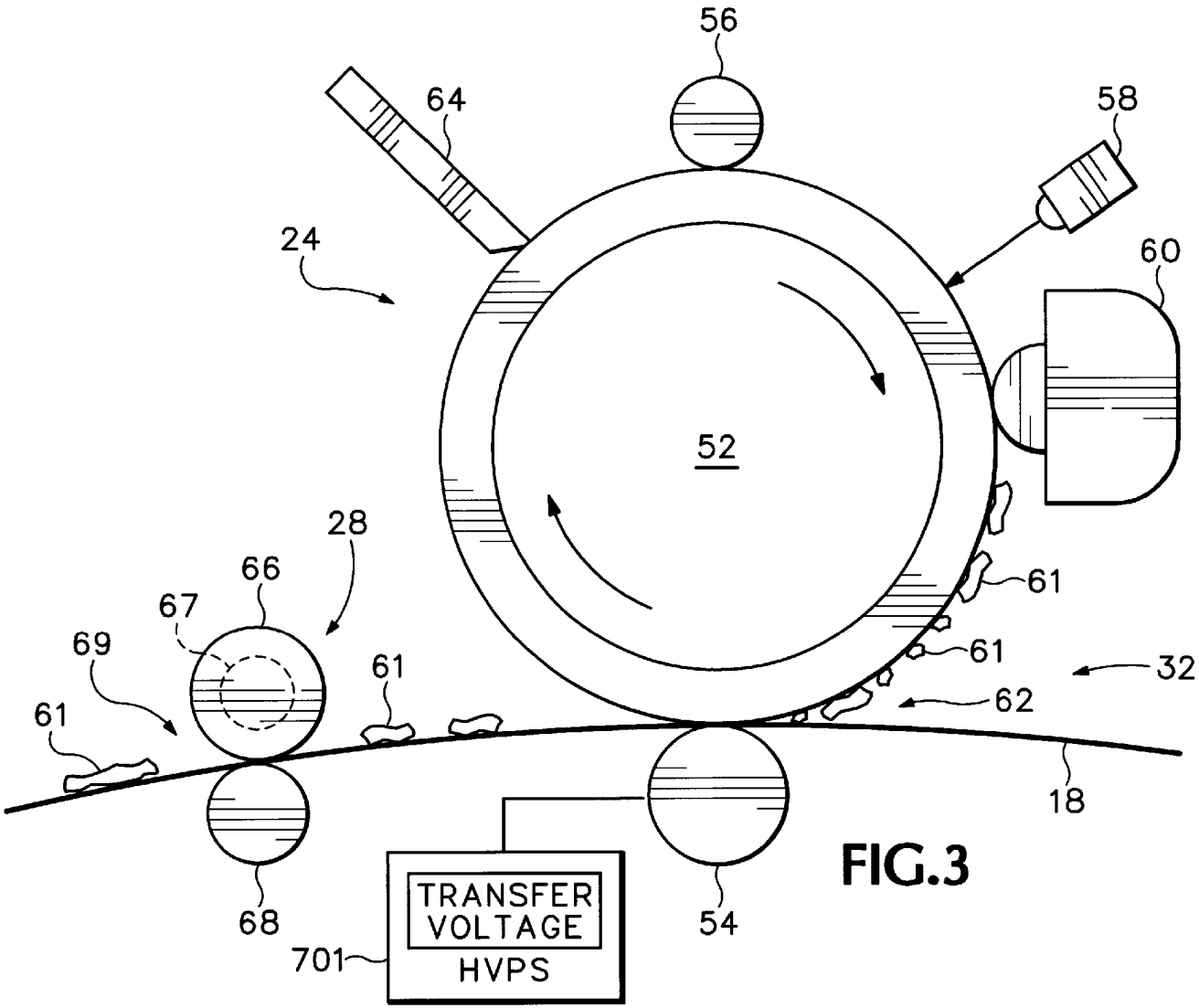
FIG. 3 is an illustrative representation of an imager and fuser subsystems of the image forming device as shown in FIG. 1.

Referring now also to FIG. 3, further details of image forming operation are described. The imager 24 subassembly includes an imaging roller (alternatively a belt) 52 and a transfer roller 54. The imaging roller 52 is a photoconductor or photosensitive drum which is insulative in the absence of incident light and conductive when illuminated. The imaging roller 52 rotates in a clockwise direction represented by arrows in FIG. 3. The rotating imaging roller 52 is charged uniformly by a charging device such as charging roller 56. The charging roller 56 provides a negative charge upon the surface of the imaging roller 52. A laser device 58 scans across the charged surface of the imaging roller 52 and writes an image to be formed by selectively discharging areas of the surface where developing material 61, e.g., toner, is to adhere. A developer 60 applies the developing material 61 on the surface when and wherever the negatively-charged developing material 61 is attracted to the discharged areas and repelled by the charged areas of the imaging roller 52 surface. A media sheet 18 being transported along the media path 32 passes through the nip 62 of the imaging roller and a transfer roller 54 where the developed image on the surface is transferred to the sheet. A bias voltage, also referred to as the "transfer voltage," from a high voltage power supply 701 is applied to the transfer roller which contacts the backside of the media sheet 18 inducing an electric field through the sheet. The magnitude of the induced field in the nip 62 between the imaging roller 52 and the transfer roller 54 is determined by the transfer voltage, the resistivity of the media sheet 18, and the dielectric thickness of the media sheet. The induced electric field causes the developing material 61 to move from the imaging roller 52 to the media sheet, forming the desired hard copy image.

Residual developing material upon the imaging roller 52 may be removed at a cleaning station 64 to prepare the imaging roller for the application of a subsequent image.

The fuser 28 subassembly is positioned downstream of the imager 24. A fusing roller 66 preferably includes internal heating devices 67 to impart a heat flux to the developing material 61 on the media sheet 18 being transported along media path 32. The media sheet 18 passes through a fuser nip 69 between the fusing roller and a pressure roller 68. Application of the heat flux fuses the developing material 61 cohesively to the media sheet 18. The temperature in the fuser nip 69 and heat flux is dependent upon the properties of the developing material 61, the velocity of the media sheet 18, the surface finish of the sheet, and the thermal conductivity and heat capacity of the sheet.

Control of the various printing operation parameters of the apparatus 10 and its subassemblies are provided in accordance with the present invention.

INPUT SENSING AND ANALYSIS

Figure 4:
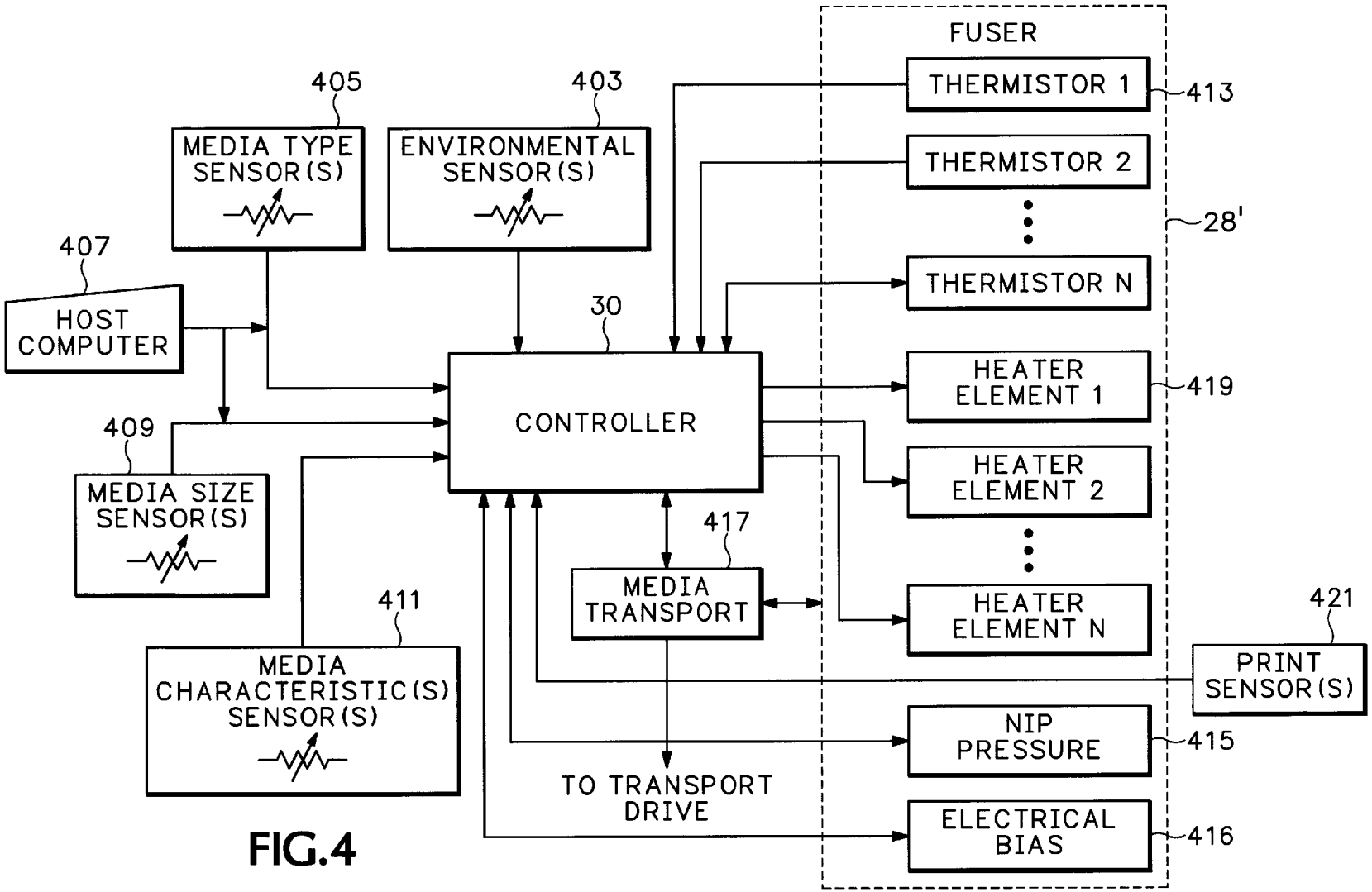
FIG. 4 is a schematic block diagram for sensing and control subsystems for an image forming device as shown in FIG. 1 in accordance with the present invention.

FIG. 4 is a schematic block diagram illustrating one embodiment of the sensing, analysis, and control subsystem in accordance with the present invention. Signal flow is represented by arrows connecting the various elements of the subsystem. Generally, the hard copy apparatus as shown in FIGS. 1, 2 and 3 includes the internal controller 30 (such as a general purpose microprocessor or application specific integrated circuit ("ASIC") based control printed circuit board), connected to a host computer 407, from which the printer operations are directed, including, for example, fuser operational parameters, i.e., the fusing subsystem temperature, pressure, transport speed operating conditions. Digital signal processing and computer code control techniques are used via the controller 30 in accordance with the state of the art.

As shown in this exemplary embodiment, specifically FIGS. 2 and 3, the fuser 28 subsystem is a roller type having a fusing roller 66 and a pressure roller 68 in peripheral contact and through the nip 69 which a developed page to be fixed is transported. In addition to the heating profiles (circumferential and cylindrical length) across the fusing roller 66 surface, other fuser assembly operational parameters, such as media speed through the nip 69, pressure in the fuser nip 69 between the rollers 66, 68, and an imposed latent electrical charge on one roller (generally the heated fusing roller 67) need to be controlled. Thus, the optimal fusing process for a specific sheet will be a function of selecting the correct heating profile, pressure, speed, and fuser charge for a next sheet to be fixed.

Returning to FIG. 4, one or more ambient "Environmental" condition sensors 403 can be distributed in the printer engine (FIG. 3) so that ambient temperature and humidity can be monitored continuously. Ambient temperature and ambient humidity detectors are well known. Digital temperature sensors such as commercially available thermocouples or thermistors can be employed; humidity sensors, such as model HMM22D or 30C manufactured by Vaisala Inc. of Sunnyvale, Calif., can be employed.

One or more "Media Type" sensors 405 can be provided on-board the printer 10 (FIG. 1). Most printer control panels 14 (FIG. 1) have end-user media type selection input capability. Most often, media type is provided from the Host Computer 407 printing application program as header code in a downloaded print job. However, the printer also can be provided with individual, automatic sensors 405 for media type detection. For example, a known manner optical detector can be located near the paper path input to determine if the next sheet of media is clear, viz. an overhead transparency, the signal from which can be used to have the controller 30 change to a transparency default set of operational parameter control settings. Thus, while a print download program instruction may be specifying plain paper, the on-board type sensors 405 may detect a transparency sheet and over-ride the download program instructions.

Looking again to FIG. 4, one or more "Media Size" sensors 409 can be provided on-board the printer 10 (FIG. 1). Most printer control panels 14 (also only in FIG. 1) have end-user media size selection input capability. Most often, media size is provided from the host computer 407 printing application program as header code in a downloaded print job. However, the printer also can be provided with individual, automatic sensors 405 for media size detection. U.S. Pat. No. 5,574,551 by Kazakoff for a PRINT MEDIA SUPPLY APPARATUS WITH MEDIA PARAMETER DETECT CAPABILITY ( assigned to the common assignee herein and incorporated herein by reference) teach an automatic detection of size of print media in a supply bin.

Moreover media size can be inferred from the print job data; U.S. Pat. No. 6,011,939, based on Ser. No. 09/126,628, filed by co-inventor Martin on Jul. 30, 1998, addresses SENSING PRINT MEDIA SIZE TO TEMPERATURE CONTROL A MULTI-HEATING ELEMENT FIXING DEVICE is incorporated herein by reference.

As shown in FIG. 4, other print media characteristic detection sensors 411 can be provided (represented jointly by a single element in FIG. 4 labeled "Media Characteristic (s) Sensor(s)"). U.S. patent application Ser. No. 09/348,650, filed by co-inventor Martin et al., on Jul. 6,1999, addresses IMAGE FORMING DEVICES, FUSING ASSEMBLIES AND METHODS OF FORMING AN IMAGE by monitoring various media qualitative characteristics to adjust fusing parameters.

A specific Next Sheet Characteristic of concern to the fusing process is media thickness. Turning briefly to FIG. 2, any simple, known manner, measurement of deflection of input feed rollers 36 or transport rollers 38 during a pick and feed cycle can provide a signal indicative of media thickness. As another known manner technique, but more costly, complex optical sensors or micrometers can be employed. In U.S. patent application Ser. No. 09/348,650, filed by Martin et al., on Jul. 6,1999, addresses IMAGE FORMING DEVICES, FUSING ASSEMBLIES AND METHODS OF FORMING AN IMAGE, the co-applicants herein disclose a number of specific techniques for determining surface characteristics of a sheet of media (assigned to the common assignee herein and incorporated herein by reference). Those devices can also be used in tandem to measure media thickness.

Another "Next Sheet Characteristic" which affects the toner fixing process is media texture, as rough media requires a higher fuser temperature than smooth media. U.S. patent application Ser. No. 09/430,356, filed by co-inventor Martin, on Oct. 28, 1999, addresses issues with respect to FIXING DEVICE CONTROL BASED UPON MEDIA TEXTURE MEASUREMENT using optical sensing (assigned to the common assignee herein and incorporated herein by reference). A commercially available, reflective sensor manufactured by Honeywell Corp. of Morristown, N.J., having part number HOA0708 can be employed to measure media texture.

Still another "Next Sheet Characteristic" which affects the toner fixing process is paper surface charge. Induced paper surface charge can be inferred from the known bias voltage and associated imposed charge employed by the image transfer subsystem (see e.g., FIG. 3, subsystem element 24 herein). The magnitude of the induced field is determined by the bias voltage and the resistivity and the dielectric thickness of the media sheet (element 18, FIG. 3). Surface charge can be detected using an appropriately adapted electrostatic voltmeter such as the commercially available model 368 by Trek Inc. of Medina, N.Y.

Yet another "Next Sheet Characteristic" which affects the toner fixing process is media temperature. Media temperature can be detected using an appropriately adapted, known manner, thermistor device such as the commercially available model 44201 by Omega company of Stamford, Conn.

A further "Next Sheet Characteristic" which affects the toner fixing process is heat capacity and thermal conductivity. These characteristics can be detected using an appropriately adapted, known manner, thermocouple device (such as the commercially available model TT-K-36 by Omega company of Stamford, Conn.) placed upstream and downstream of the fuser (or other known heat sources sought to be controlled).

A further "Next Sheet Characteristic" which affects the toner fixing process is media resistivity (surface and volume). Media resistivity can be detected using an appropriately adapted, known manner electrometer such as the commercially available model MCP-HT450 by Mitsubishi Chemical company of Tokyo, Japan, or an appropriately adapted, electrostatic measurement system such as the commercially available model DRA-2000L, commercially available from Quality Engineering Associates, Burlington, Mass.

Still another "Next Sheet Characteristic" which affects the toner fixing process is media moisture content. Moisture content can be detected using an appropriately adapted moisture content meter such as the commercially available model MOISTREX™ MX5000E by Infrared Engineering Limited company of Essex, England.

Thus, in combination, the various media sensors 405, 409, 411, collectively referred to as the input sensors, provide the controller 30 with important information with respect to the media 18 (FIG. 3), while the Environmental Sensor(s) 403 provide ambient environmental current condition data.

Where practical, it would be advantageous if the sensors employed in the present invention be adjustable in sensitivity (shown symbolically as a variable resistor/potentiometer) so that post-manufacturing testing and adjustments can be made to calibrate the system and optimize performance.

It should be recognized at this point that not all of these detection devices may be necessary for a particular implementation. Depending upon the printer used and the variety of media types supported thereby, the monitored characteristics and conditions can be limited. Moreover, each sensor output variable can be weighted during signal analysis by the controller 30; in other words, for each implementation, the appropriate sensor devices need to be prioritized and weighted and a cost effective design developed.

FUSER SENSING, ANALYSIS, OPERATION

Returning to FIG. 4, the fuser 28' subassembly operational conditions feedback is critical to optimizing the current, as well as next, fusing cycle. It is known in the art to divide a fuser roller 66 or the like into a plurality of heat zones, 1 through N, related to different media sizes which can be employed by the printer 10 (FIGS. 1 & 2). Thus, a thermistor 413 is positioned to provide a feedback signal to the controller 30 indicative of current temperature in each zone (represented by boxes labeled "Thermistor 1". . . "Thermistor N") or relative to a predetermined set of zones.

As discussed in the Background section above, a fuser 28/28' operational parameter critical to the fixing process is the pressure in the nip 69. Pressure in the nip is controlled by any known manner electromechanical adjustment device such as a solenoid with the pressure measured by a known manner gauge such as an adapted load cell model LCL-040G, by Omega company (the entire mechanism represented in FIG. 4 as a box labeled "Nip Pressure" 415).

Again, as discussed hereinabove, another fuser 28/28' operational parameter critical to the fixing process is the latent charge at the fuser roller 66. Any known manner potential source, such as brush 72, FIG. 2, can be employed to create the "Electrical Bias" 416.

Media speed through the nip will determine fixing dwell time. Media transport mechanisms through the printer 10 (FIGS. 1 & 2) are well known in the art and therefore represented simply as the "Media Transport" 417.

Thus, as with the environmental 403 and input sensors 405, 409, 411, the fuser 28' condition sensors and control devices 413, 415, 416, 417 also provide feedback to the controller 30 so that real time adjustments can be made to the fuser heater elements 419 ("Heater Element 1" . . . "Heater Element N"), Media Transport 417 mechanisms, Nip Pressure 415 and Electrical Bias 416 control mechanisms.

OUTPUT SENSING AND ANALYSIS

The final print output to the outfeed tray 16 (FIGS. 1 & 2) can be analyzed by one or more "Print Sensor(s)" 421 (FIG. 4) as the sheet 32 passes from the fuser 28 to the delivery rollers 44 and output rollers 46 (FIG. 2 only). Print quality detection can be used to analyze several characteristics and provide feedback to the controller 30.

One important characteristic of print quality is media moisture content. As with the Media Characteristic(s) detection devices 411 on the input side of the fuser 28/28', moisture content can be detected using an appropriately adapted moisture content meter such as the commercially available model MOISTREX™ MX5000E by Infrared Engineering Limited company of Essex, England. If the moisture content is above a predetermined threshold for the media type, a signal indicative of the condition can be sent to the controller 30 such that the temperature in the appropriate heater elements 419 is increased.

Another important characteristic of print quality is the condition of the sheet 18 (FIG. 3) as a whole. If the output print is excessively curled, scallop-edged, wavy (also known as "potato chipping"), cockled, or otherwise deformed, a likely cause is too high a temperature in the fuser 28/28'. Known manner optical or mechanical planarity displacement detection devices can be employed. Moreover, the mechanisms taught in U.S. patent application Ser. No. 09/348,650, filed by Martin et al., on Jul. 6, 1999, addresses IMAGE FORMING DEVICES, FUSING ASSEMBLIES AND METHODS OF FORMING AN IMAGE (assigned to the common assignee herein and incorporated herein by reference) and provides a number of specific techniques for determining surface characteristics of a sheet of media.

Yet another important characteristic of print quality is toner adhesion strength. This is a more difficult characteristic to determine because known, reasonably costed, detection methods require destruction of the print. Known manner scratch tests and devices in which the force is measured to shear print from the surface would require a test sheet for the media of choice would have to be run through a complete printing cycle. Such devices are expensive piece parts. However, these factors do not preclude the use of such devices, providing feedback signals for adjusting fuser temperature zones and fuser nip pressure in combination in a printer or plotter where output is critical and each copy is relatively expensive, e.g., D-size, full color, engineering plots, art and photographic or art prints and posters, and the like. Adaptable optical sensing of print characteristics on media are disclosed, for example, in U.S. Pat. No. 5,825,378 (Beauchamp), U.S. Pat. Nos. 5,600,350 and 5,404,020 by Cobbs et al., U.S. Pat. No. 5,451,990 (Sorenson et al.) (each assigned to the common assignee herein and incorporated herein by reference).

CONTROLLED FUSER OPERATIONS

Figure 5:
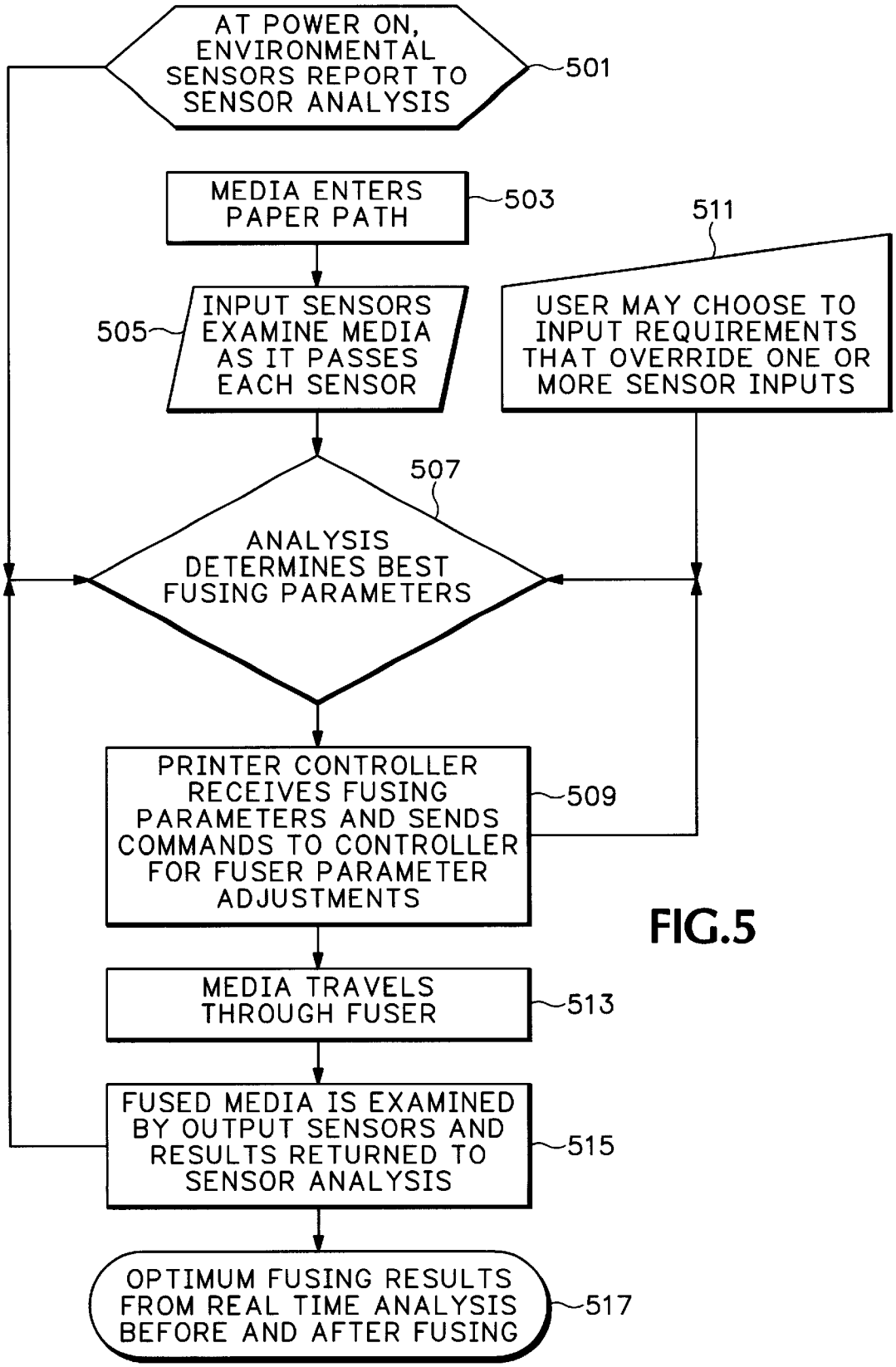
FIG. 5 is a flow chart of the basic process in accordance with the present invention using the equipment as shown in FIGS. 1–4.
Figure 6:
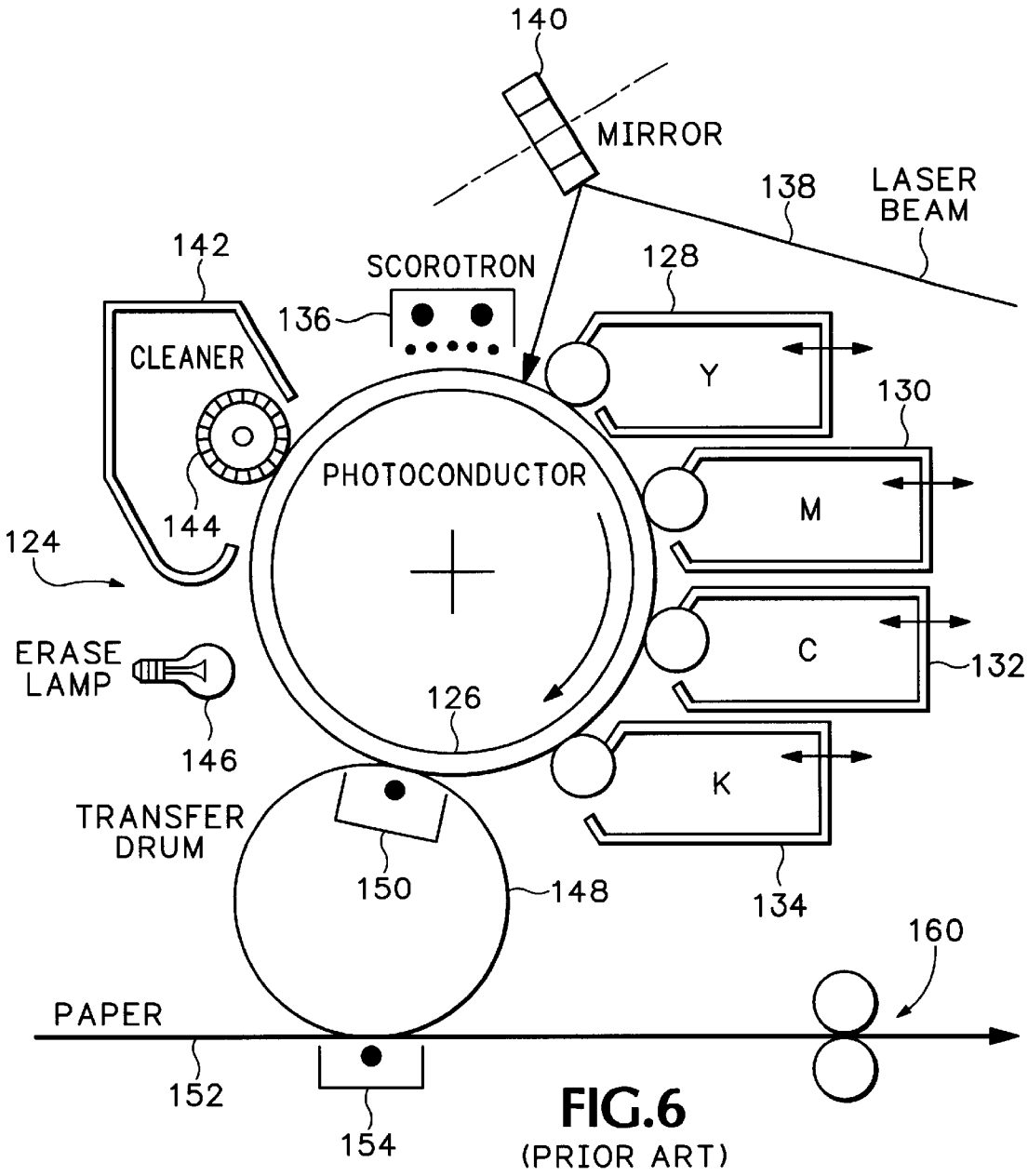
FIG.6 (PRIOR ART)
FIG. 6 (Prior Art) is an exemplary laser-type electrophotographic hard copy apparatus.

In addition to FIGS. 1–4, refer now also to FIG. 5. From the very start of printer operation, step 501, optimization can begin. Predetermined default settings for the fuser subsystem 28/28' can be set and then immediately adjusted if signals from the Environmental Sensor(s) 403 indicate via the controller 30 analysis if better initial fuser optimization settings should be set.

Media (18, FIG. 2) is then picked (34) and fed (36, 38, 40, 42), step 503, through the imaging and transfer subsystems (17, 26, 24) while, based on the signals from the Environmental Sensor(s) 403, host computer input 407, the indicative feedback signals, step 505, of Media Type sensor(s) 405, Media Size Sensor(s) 409, and Media Characteristics Sensors 411 are sent to the controller 30. Real time analysis of theses signals, step 507, determines the best current fusing parameters which are converted by the controller, step 509, into commands for fuser assembly operational parameter adjustments, namely, temperature, heating profile, nip pressure, and latent charge. The box labeled step 509 also represents fuser conditions reported generally continuously by sensors 413, 415, 416 from the time power ON is initiated as with step 501.

For one simple example, based on the input sensor 403, 405, 409, 411 signals, a beginning temperature in appropriate zones of the fuser roller 66 can be set by the controller 30. If a print job calls for many copies, the fuser temperature can be set for continuous heating of the appropriate zones rather than turning on and off for each sheet wherein heating profile fluctuations could effect print quality over the job run.

Note that it also is specifically intended that the end-user have control capability to input requirements that override one or more sensor inputs, step 511.

The media 32 travels through the fuser 28 subsystem, step 513.

As the media 32 passes from the fuser 28 subsystem via the output transport mechanism 44, 46 to the outfeed tray 16, output print quality characteristics are detected by the Print Sensor(s) 421, step 515, and fed back to the controller 30 (note FIG. 5 feedback arrow to step 507). In other words, during or once a first sheet has been fixed, feedback from the fuser 28/28' (nip pressure, media speed, electrical charge on the fuser roller) and Print Sensor(s) 421 provide further feedback for further fuser operational parameter updating. Thus, optimum fusing commands results from real time analysis of media and environment characteristics and fuser operations, step 517, for each sheet printed before, during, and after fixing the toner to the sheet.

A specific example of sensor analysis and fuser parameter setting now can be explored in the nature of logical truth tables and known manner lookup table ("LUT") digital memory. Let the Heater Elements 419 be numbered En where n is the element number for each predetermined zone and odd numbers represent full width zones.

For the Media Size Sensor(s) 409, let paper size be factor P1=n, where e.g., n=1 for narrowest size, n=2 widest size, as would be appropriate for a particular implementation.

For the Media Characteristic(s) Sensor(s) 411, let paper resistivity be factor R1=n, where e.g., n=1 for a low resistance, n=2 for a moderate resistance, n=3 for a high resistance; let paper texture be factor R2=n, where e.g., n=1 for rough, n=2 for normal, n=3 for smooth; let paper thickness be factor T1=n, where e.g., n=1 for thick, n=2 for normal, n=3 for thin.

For the Environmental Sensor(s) 403, actual air temperature and humidity can be in standard units and related to temperature and moisture content input and feedback signals, so let factor T2="Xn" for temperature and factor H1="Xn" for humidity.

For the fuser 28/28', let factors T3 be the response for a thermistor located a first edge of the heated fusing roller 66 and let T4 be the response for a thermistor in the center of the heated fusing roller.

For the Electrical Bias 416, let factor F1=fuser electrical bias in standard units, e.g. volts.

For the Media Transport 417, let factor S1=n, where n=1 for fast speed, n=2 normal speed, n=3 for slow speed.

To continue the example, assume nip bias pressure is a constant, if analysis determines:

P1=1
R1=1
R2=2
T1=2
T2=X1
H1=X2
T3<260° F.
T4<180° F.

then the controller sets:

E1 ON FULL
E2 ON HALF
S1=1
F1=−500V.

As another example, if analysis determines:

P1=2
R1=2
R2=3
T1=1
T2=X1
H1=X2
T3<260° F.
T4<180° F.

then the controller sets:

E1 ON FULL
E2 OFF
E3 ON FULL
S1=2
F1=−600 VOLTS.

It will be recognized by those skilled in the art of digital and analog controls for electromechanical systems that a number of other methodologies can be employed in accordance with the present invention.

Note that the memory used to store values can be active, namely refreshing its own look-up table data for particular media based on output characteristics of actual media employed by the end user under actual operating conditions.

As another specific example of fully automated operation, assume the printer 10 (FIGS. 1, 2) is at a default setting, e.g., for standard #20 plain paper in input tray 20 most often used for printing. The ambient Environmental Sensor(s) 403 are providing the controller 30 with continual readings and the controller makes adjustments accordingly. Now assume, a standard, but relatively rough surfaced, Commercial #10 envelope is input to the printer 10. Media type sensor 405

(FIG. 4) signals the change of media type to the controller 30. The exact width and thickness are detected by Media Size sensor(s) 409; namely, that it is a narrow, yet thicker media than the #20 plain paper. Since, the media is narrow, thus only a narrow cross fusing roller 66 heating profile is needed. The Media Characteristic(s) Sensor(s) 411 determine that the roughness is relatively high, that the moisture content is relatively low, and that the surface charge is highly negative. In such a case, the toner 61 (FIG. 3) will have a difficult time adhering since the surface charge is highly negative, the surface roughness is high, and the thickness is also high. Therefore, the controller 30 determines that there should be applied a higher than usual heat, a highly negative charge on the fusing roller 66 to repel the toner 61 and keep it pressed to the media, and the normal force can be adjusted to prevent thick, narrow media from being wrinkled. After the envelope exits the fuser 28, assume the Print Sensors(s) detect low moisture content in the media, high curl, and good toner adhesion. Assuming the next sheet of media to be printed is another Commercial #10 envelope (or is detected 405, 49, 411 to have characteristics within the same tolerance band); based on this feedback from the Print Sensor(s) 421, the controller 30 lowers the temperature slightly and the next sheet is printed and fixed accordingly.

In summary, this aspect of the present invention provides a print fusing subsystem (generally FIG. 4) in a hard copy apparatus 10 uses automated sensing devices 403, 405, 409, 411, 413, 415, 416, 417, 421 to provide current condition input signals and operational feedback signals to optimize (generally FIG. 5) the fusing subsystem operational parameters. Monitoring of ambient environmental conditions, subsystem operational parameters, and a print medium 18 from input 20, 34, 36, 38, 40 through output 44, 46, 16, and the final printed text or image for predetermined characteristics is used to generate signals indicative of conditions that can be altered by commands to the fusing subsystem to optimize print quality.

EXPANDED SYSTEM EMBODIMENT

Figure 7:
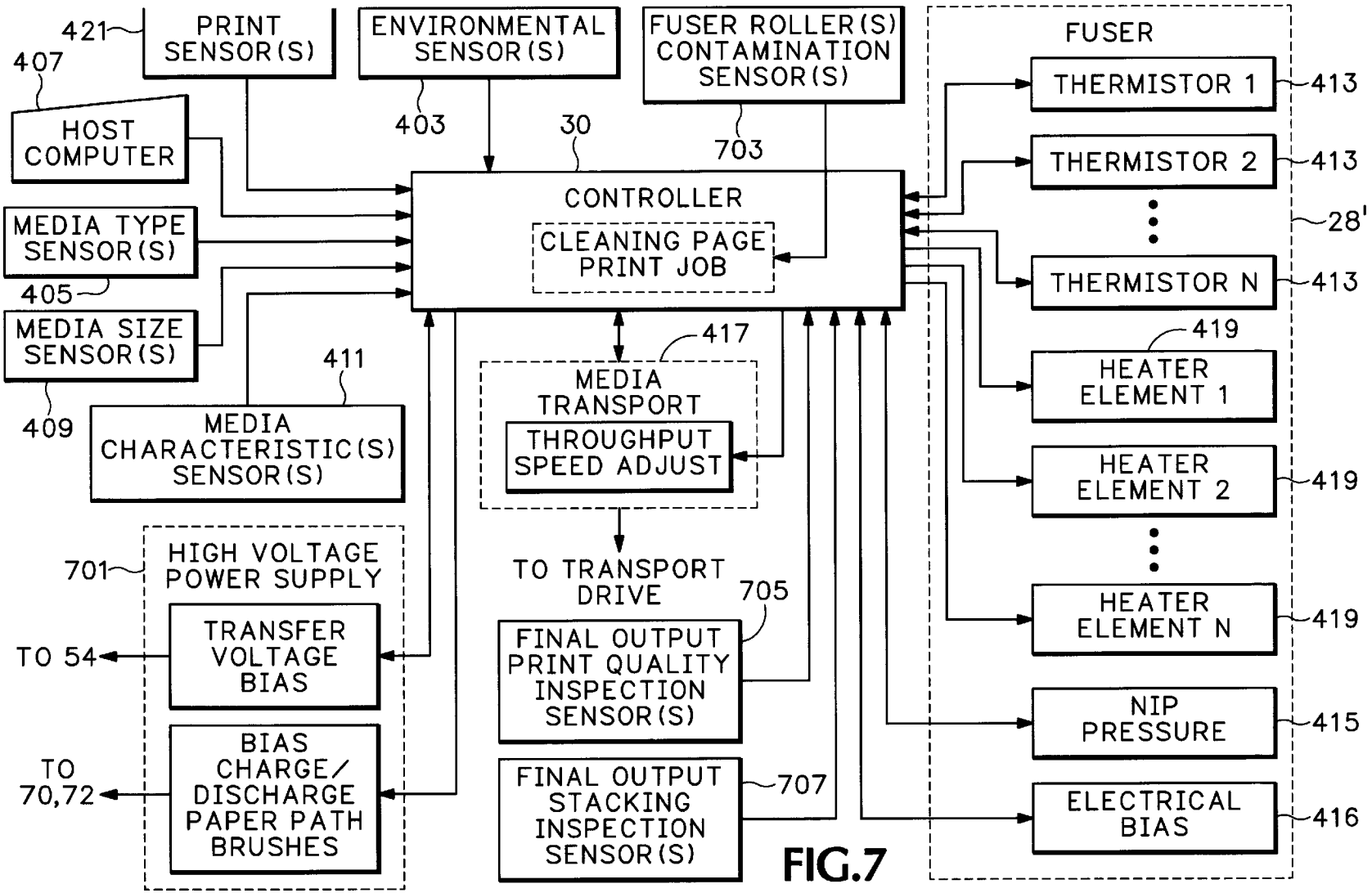
FIG. 7 is an alternative embodiment of the present invention including the embodiment shown in FIG. 4.

FIG. 7 is a schematic block diagram for the present invention in which the feedback from the sensors has been given an expanded roll in controlling various subsystems of the printer 10 to optimize process operational parameters.

In addition to controlling fuser 28' operational parameters as shown in FIGS. 4 and 5 based on feedback from the plurality of sensors 403, 405, 409, 411, 421, the "High Voltage Power Supply" ("HVPS") 701 operation via the controller 30 can also benefit from sensor data feedback. Among other functions, the HVPS 701 controls the transfer voltage for the transfer drum 54 as previously described with respect to FIG. 3. In the state of the art, the end-user has to know that the currently used media has, for example, a relatively high resistivity and then make manual adjustments to the transfer voltage bias via the control panel 14 (FIG. 1) to prevent print quality defects. As described with respect to FIGS. 2–5, printing operational parameters such as resistivity of the media are directly related to the electrophotography process voltage requirements.

Furthermore, the HVPS 701 controls the bias to electrostatic charge brushes and discharge brushes 70, 72 in the paper path 32 (FIG. 3). It will be recalled that the Media Characteristic(s) Sensor(s) 411 provides data regarding the charge of the media sheet.

An additional sensor, "Fuser Roller(s) Contamination Sensor(s)," 703 is provided to detect the presence of residual toner on one or both rollers 66, 68. Detail of a specific implementation is described in U.S. patent application Ser. No. 09/384,716, filed by co-inventor Martin et al., on Aug. 26, 1999, addresses issues with respect to METHOD AND APPARATUS FOR DETECTING IMAGE MEDIUM SURFACE DEFECTS IN AN IMAGING SYSTEM (assigned to the common assignee herein and incorporated herein by reference).

In the state of the art, media transport speed is generally set for a different fixed speed depending on the size and type of media being run through the printing cycle. Media throughput speed can be more closely controlled by any number of known manner devices such as automated multi-speed or variable speed transmission mechanisms (generically represented in FIG. 7 by a box labeled "Throughput Speed Adjust") being incorporated into the Media Transport controls 417.

Two other sensor devices 705, 707 are provided for inspecting the finished hard copy product output. After the media sheet has finished printing and is output into tray 16 (FIG. 1), it can be inspected by optical sensing devices. For example, the IAS-1000, Automated Image Analysis System, manufactured by Quality Engineering Assoc, Inc. company of Burlington, Mass., might be adaptable for use in accordance with the present invention. Such optical sensing devices can be employed to recognize and provide feedback data to the controller 30 by sensing output print quality ("Final Output Print Quality Inspection Sensor(s)" 705) or stacking problems ("Final Output Stacking Inspection Sensor(s)" 707).

Additionally, the hard copy apparatus controller 30 sensor analysis component is provided with a routine for instigation of cleaning subsystems of the hard copy apparatus 10. Specific embodiments are described in detail in U.S. patent application Ser. No. 09/384,716, filed by co-inventor Martin et al., on Aug. 26, 1999, addresses issues with respect to METHOD AND APPARATUS FOR DETECTING IMAGE MEDIUM SURFACE DEFECTS IN AN IMAGING SYSTEM (assigned to the common assignee herein and incorporated herein by reference). As other examples, a "Cleaning Page Print Job" option can be employed such as described in U.S. Pat. Appl. Ser. No. 09/584,019, filed by Roche for a CLEANING MEDIUM FOR INK-JET HARD COPY APPARATUS on May 30, 2000, or U.S. Pat. No. 5,589,865 by Beeson for an INKJET PAGE-WIDE-ARRAY PRINTHEAD CLEANING METHOD AND APPARATUS (each assigned to the common assignee herein and incorporated herein by reference). In essence, the action to be instigated is that when the sensor 703 determines the pressure roller 68 is dirty, a cleaning page command is issued and a special media to clean the roller is transported through the media path 32 accordingly.

EXPANDED SYSTEM OPERATIONS

Figure 8A:
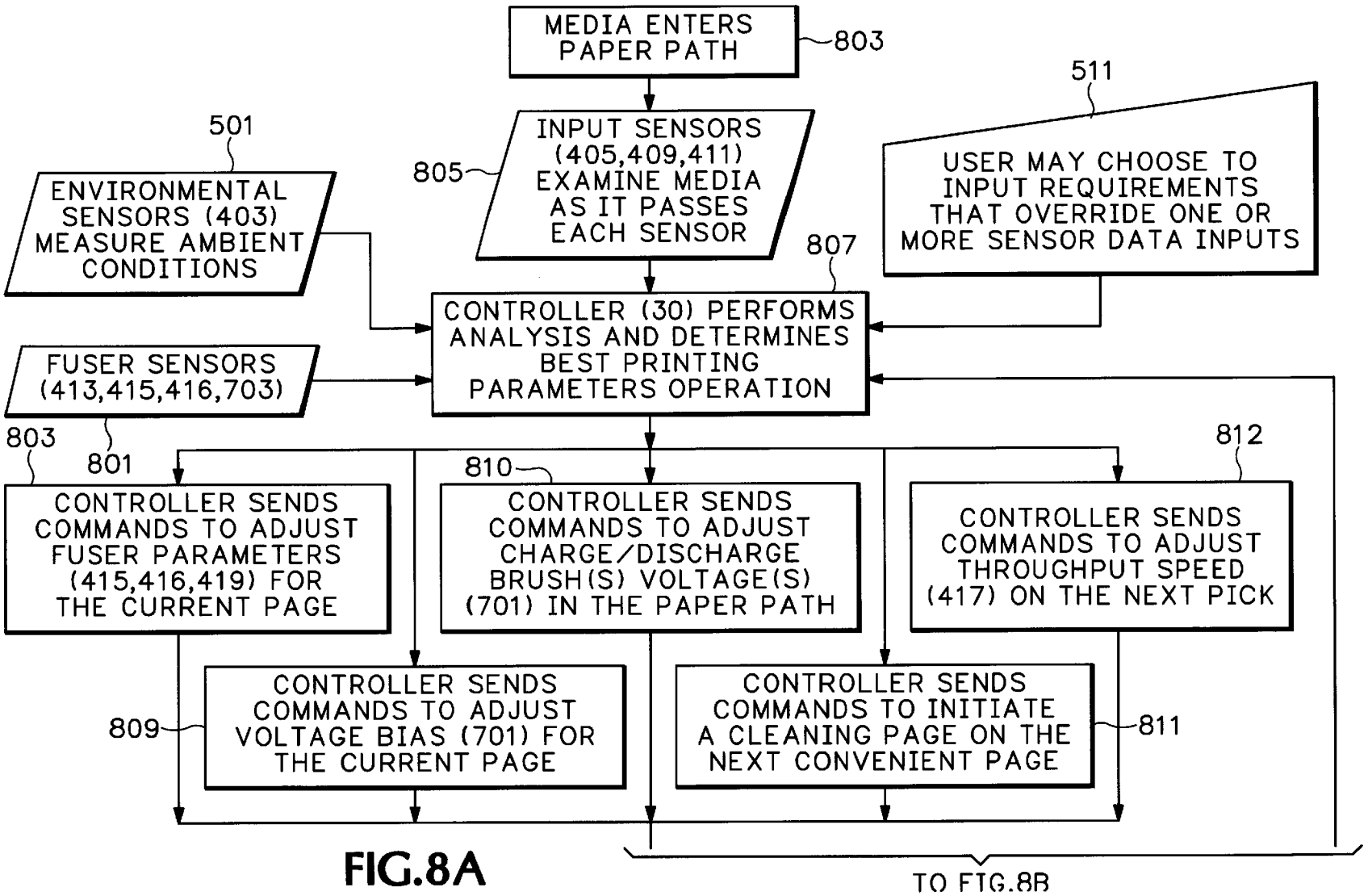
FIG. 8 is a flow chart of the basic process in accordance with the present invention as shown in FIG. 7.
Figure 8B:
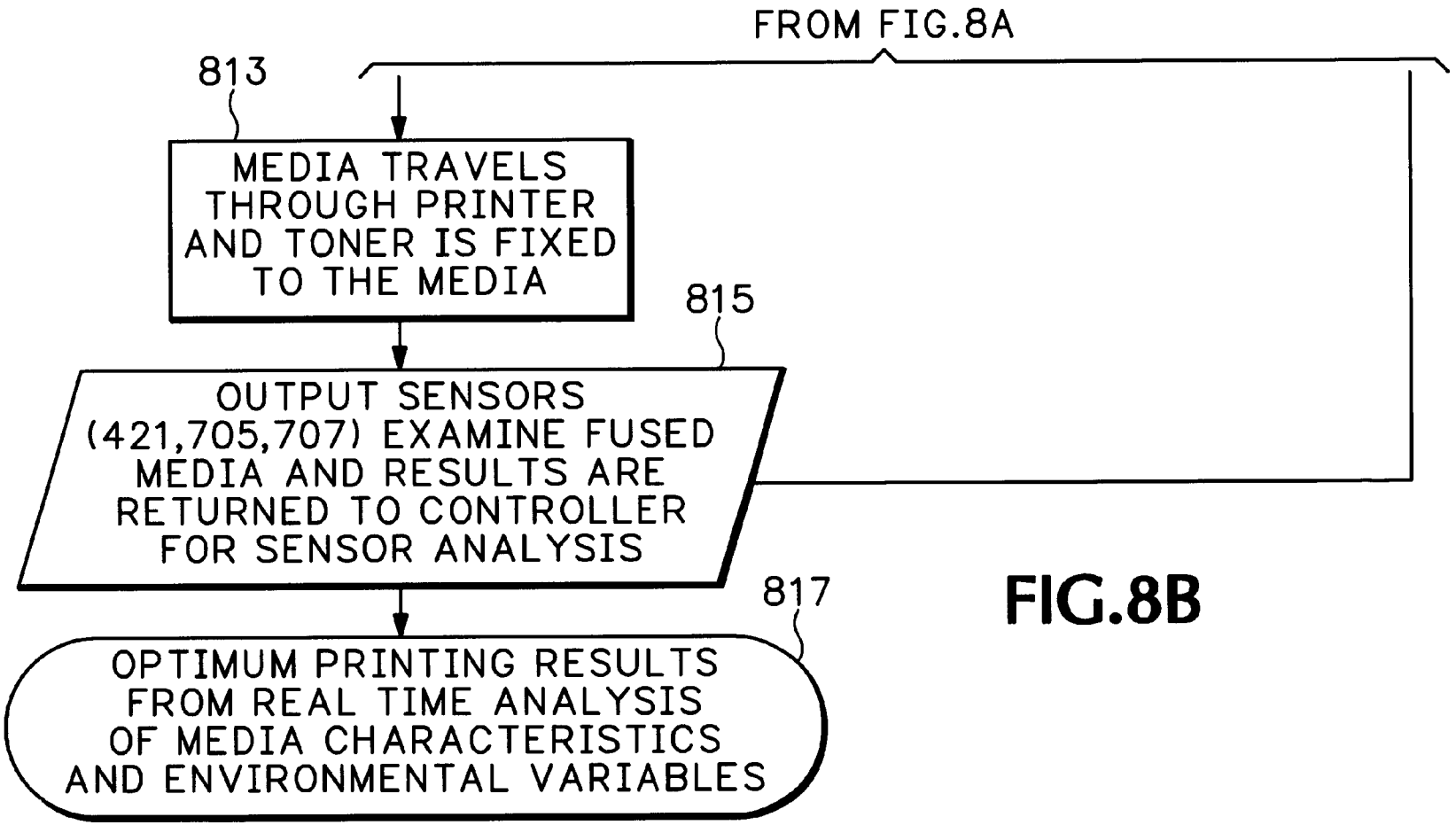

FIG. 8 is a flow chart depicting typical operations of the system shown in FIG. 7. Reader reference also to FIGS. 2 and 3 in the course of the following description will be helpful. As can now be recognized, the plurality of sensors employed can have interactive feedback coordinated and controlled by the controller 30.

As in FIG. 5, step 501, at a power ON, the Environmental Sensor(s) 403 begin reporting the current ambient environmental conditions to the controller 30 sensor analysis component.

Fuser 28' sensors 413, 415, 416, 703 begin sending data representative of the fuser current status conditions, step 801.

Additionally, as in the embodiment of FIG. 5, via the control panel 14, or via the host computer 407 (FIGS. 4 and 7), the end-user may choose to input specific requirements that will override one or more sensor inputs, step 511.

In the course of normal operations, the media sheet 18 enters the media path 32, step 803. The input sensors 405, 409, 411 examine the incoming sheet, step 805. Data from the input sensors 405, 409, 411 is received by the controller 30, analyzed, and optimal printing operational parameters are determined, step 807.

The controller 30 determines and transmits various command functions, steps 807, 808, 809, 810, 81 1, and 812, as required for each controlled system, e.g., fuser 28/28', HVPS 701, Media Transport 417, or other printer subsystems so affected, based upon the feedback data. The operations are shown in parallel to once again indicate that the feedback data may have interactive implications which can be taken into account by the controller data analysis routines in reaching specific determinations as to optimal printing operation parameter adjustments.

The media sheet 18 is transported through the nip 62 between the imaging roller 52 and the transfer roller 54, printing the current page image; the media sheet 18 continues through the nip 69 in the fuser 28, fixing the image, step 813.

Next, downstream of the fuser 28/28', the output sensors 421, 705, 707 examine the printed page. Data indicative of the printing operation results is fed back to the controller 30, step 815.

Note that when located immediately downstream adjacent to the fuser 28/28', the Print Sensor(s) 421 can provide nearly instantaneous feedback and dynamic adjustments can be made to the fuser 28/28'for the current page being processed.

The process culminates 817 with optimum printing results due to the real time analysis of media characteristics and current operating and environmental conditions.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. While the present invention has been described with respect to a laser hard copy apparatus using commercial electrophotography toner developing processes, it will be recognized by those skilled in the art that the present invention is applicable to other hard copy apparatus, such as ink-jet printing technology, where a different wet colorant is used to form the alphanumeric text characters and graphic images. Moreover, the present invention is applicable to any printing process using a post-printing cycle print fixing process. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . ."

What is claimed is:

1. A print fusing system, comprising:

print fuser having a plurality of individually controllable heaters;

a controller connected to said heaters;

connected to said controller, at least one sensor for ambient environmental conditions, at least one sensor for media parameters, at least one sensor for current print fuser system conditions, such that signals from each said sensor to said controller are provided to said controller for adjusting fusing system conditions to optimal for the next media sheet passing therethrough; and override controls for providing input requirements that override one or more sensor input signals to the controller.

2. The system as set forth in claim 1, further comprising:

connected to said controller, at least one print sensor for print quality detection such that a signal from said print sensor is provided to said controller for adjusting fuser system conditions to optimal for the next media sheet passing therethrough.

3. The system as set forth in claim 2, said at least one print sensor for print quality detection providing signals indicative of print quality characteristics comprising:

an output sensor wherein said characteristics are selected from a group including media temperature, media deformation, and toner adhesion strength.

4. The system as set forth in claim 1, said at least one sensor for ambient environmental conditions comprising:

a plurality of ambient environmental condition sensors including at least one temperature sensor and at least one humidity sensor.

5. The system as set forth in claim 1, said at least one sensor for media parameters comprising:

at least one media type sensor.

6. The system as set forth in claim 1, said at least one sensor for media parameters comprising:

at least one media size sensor.

7. The system as set forth in claim 1, said at least one sensor for media parameters comprising:

at least one sensor for detecting media characteristics of a currently sensed sheet.

8. The system as set forth in claim 7, comprising:

said media characteristics are selected from a group including texture, temperature, heat capacity, moisture content, thickness, resistivity, and latent electrical charge.

9. The system as set forth in claim 1, comprising:

said controller is connected for receiving media size and type information from a host computer.

10. The system as set forth in claim 1, said at least one sensor for current fuser system conditions comprising:

at least one temperature sensing and control device for each of said heaters.

11. The system as set forth in claim 1, said at least one sensor for current fusing system conditions comprising:

at least one electrical potential sensing and control device for said fuser system.

12. The system as set forth in claim 1, said fuser including a mechanism for pressurizing a sheet of media passed through the fuser, said at least one sensor for current fusing system conditions comprising:

at least one pressure sensing and control device.

13. A method for controlling hard copy apparatus' subsystems' printing operation parameters, via a hard copy apparatus controller, the method comprising:

recognizing print medium characteristics during said medium input;

recognizing said subsystems' printing operation parameters current states;

based on said steps of recognizing print medium characteristics and recognizing said current states, commanding said subsystems to adjust printing operation parameters from said current states to adjusted states for optimizing print quality in accordance with said characteristics;

recognizing print medium condition characteristic changes as said medium progresses along a media path through said apparatus, and commanding said subsystems to adjust printing operation parameters substantially continuously to the adjusted states for optimizing print quality in accordance with said characteristic changes.

14. The method as set forth in claim 13, the step of recognizing print medium characteristics as said medium is input comprising:

actively sensing said characteristics, and providing signals indicative of said characteristics to said controller for performing the step of commanding.

15. The method as set forth in claim 14, the step of actively sensing said characteristics further comprising:

sensing media type characteristics, media size characteristics, and media conditions.

16. The method as set forth in claim 13, the step of recognizing said subsystems' printing operation parameters current states comprising:

recognizing current ambient environmental conditions.

17. The method as set forth in claim 16 comprising further:

commanding said subsystems to adjust printing operation parameters for optimizing print quality in accordance with dynamic changes in said current ambient environmental conditions.

18. The method as set forth in claim 13 further comprising the steps of:

recognizing current ambient environmental conditions as said medium progresses along a media path through said apparatus, and commanding said subsystems to adjust printing operation parameters substantially continuously to the adjusted states for optimizing print quality in accordance with dynamic changes in said current ambient environmental conditions.

19. The method as set forth in claim 13, the step of recognizing said subsystem's printing operation parameters current states comprising:

substantially continually determining operational parameters associated with the current state of a high voltage power supply.

20. The method as set forth in claim 19, comprising the further steps of:

monitoring an electrophotography transfer voltage, and adjusting said transfer voltage as said medium progresses along a media path through said apparatus for optimizing print quality in accordance with said characteristics.

21. The method as set forth in claim 19 comprising the further steps of:

monitoring electrostatic charge conditions associated with said medium as said medium progresses along a media path through said apparatus, and adjusting electrical bias on devices for altering electrostatic charge conditions associated with said medium for optimizing print quality in accordance with said characteristics.

22. The method as set forth in claim 13, the step of recognizing said subsystem's printing operation parameters current states comprising:

substantially continually determining operational parameters associated with throughput speed as said medium progresses along a media path through said apparatus.

23. The method as set forth in claim 22 comprising the step of:

adjusting said throughput speed for optimizing print quality in accordance with said characteristics.

24. The method as set forth in claim 13, the step of recognizing said subsystem's printing operation parameters current states comprising:

substantially continually determining operational parameters associated with fixing an image to said medium as said medium progresses along a media path through said apparatus.

25. The method as set forth in claim 24 comprising the step of:

adjusting said operational parameters associated with fixing an image to said medium for optimizing print quality in accordance with said characteristics.

26. The method as set forth in claim 24 comprising the further step of:

monitoring apparatus associated with the step of fixing an image for contamination of the apparatus, and commanding a cleaning cycle of said apparatus associated with the step of fixing when a predetermined threshold of contamination is exceeded.

27. A method for controlling hard copy apparatus'subsystems'printing operation parameters, via a hard copy apparatus controller, the method comprising:

recognizing print medium characteristics during said medium input;

recognizing said subsystems'printing operation parameters current states;

based on said steps of recognizing print medium characteristics and recognizing said current states, commanding said subsystems to adjust printing operation parameters from said current states to adjusted states for optimizing print quality in accordance with said characteristics;

outputting the medium having an image printed thereon;

inspecting the medium with respect to post-printing characteristics;

providing signals to said controller indicative of current post-printing characteristics; and commanding said subsystems to adjust printing operation parameters from said current states to adjusted states for optimizing print quality in accordance with said post-printing characteristics for a next sheet of medium to be printed.

28. A hard copy apparatus, having means for electrophotographically processing image printing data as a printed page and means for controlling the means for electrophotographically processing image printing data, including printing and media transport subsystems thereof, comprising:

connected to the means for controlling, at least one sensor for ambient environmental conditions, at least one sensor for media parameters and at least one sensor for print quality characteristics, wherein signals from each said sensor to said means for controlling are provided to said means for controlling for determining and adjusting operational parameters of said means for electrophotographically process image printing data to optimal levels for printing the image data on a media sheet passing through said apparatus;

wherein the at least one sensor for print quality characteristics comprises:

sensors for providing signals indicative of post-printing characteristics of said printed page; and said characteristics are associated with both image quality and with medium condition.

29. The apparatus as set forth in claim 28, further comprising:

at least one sensor for determining contamination levels of predetermined subsystems of said means for electrophotographically processing printing image data into a printed page, and the means for controlling further including means for commanding cleaning operations when said sensor for determining contamination levels indicates contamination levels exceeding a predetermined threshold.

30. The apparatus as set forth in claim 28, comprising:

said controller provides commands for adjusting a high voltage power supply having controllable bias potential outputs associated with predetermined said subsystems of said means for electrophotographically processing printing image data into a printed page.

31. The apparatus as set forth in claim 28, comprising:

said controller provides commands for adjusting media throughput speed devices associated with predetermined said subsystems of said means for electrophotographically processing printing image data into a printed page.

32. The apparatus as set forth in claim 28, comprising:

said controller provides commands for adjusting operational parameters of fusing subsystems of said subsystems of said means for electrophotographically processing printing image data into a printed page.

33. The apparatus as set forth in claim 28, wherein the at least one sensor for print quality characteristics further comprises:

sensors for providing signals indicative of current print medium characteristics selected from the group including media thickness, media texture, media surface charge, media temperature, media heat capacity, media thermal conductivity, media electrical resistivity, media latent charge, and media moisture content.

34. The apparatus as set forth in claim 28, comprising:

said means for controlling processes signals from said at least one sensor for ambient environmental conditions, at least one sensor for media parameters and at least one sensor for print quality characteristics in a determinatively interactive manner such that commands are sent by said means for controlling to electrophotographic processing subsystems of said apparatus substantially in real time, setting optimal levels for printing the image data on a current media sheet passing through said apparatus.

35. A memory device having a program for controlling electrophotography device subsystems comprising:

computer code enabling the recognition of signals indicative of print media characteristics, signals indicative of printed image characteristics, and signals indicative of current electrophotography device subsystems operational parameters;

computer code determining optimal electrophotography device subsystems operational parameters based upon analysis of said signals indicative of print media characteristics and signals indicative of printed image characteristics;

computer code commanding adjustments to the electrophotography device subsystems operational parameters based upon the analysis of said signals indicative of print media characteristics and signals indicative of printed image characteristics; and computer code analyzing signals indicative of post-printing image quality and post-printing media condition characteristics.

36. The device as set forth in claim 35, further comprising:

computer code enabling the recognition of signals indicative of current ambient environmental conditions affecting print quality; and computer code commanding adjustments to the electrophotography device subsystems operational parameters based upon the analysis of said signals indicative of the current ambient environmental conditions.

37. The device as set forth in claim 35, comprising:

computer code analyzing signals indicative of current print medium characteristics selected from the group including media thickness, media texture, media surface charge, media temperature, media heat capacity, media thermal conductivity, media electrical resistivity, media latent electrical charge, and media moisture content.

38. The device as set forth in claim 35, the computer code commanding adjustments to the electrophotography device subsystems operational parameters further comprising:

computer code routines selected from the group including computer code for controlling image fusing subsystems, computer code for controlling high voltage biases to apparatus subsystems, and computer code for controlling apparatus subsystems associated with throughput.

39. A hard copy apparatus, having means for electrophotographically processing image printing data as a printed page and means for controlling the means for electrophotographically processing image printing data, including printing subsystems and media transport subsystems thereof, comprising:

connected to the means for controlling, at least one sensor for ambient environmental conditions, at least one sensor for media parameters, and at least one sensor for print quality characteristics, wherein signals from each said sensor to said means for controlling are provided to said means for controlling for determining and for adjusting operational parameters of said means for electrophotographically process image printing data to optimal levels for printing the image data on a media sheet passing through said apparatus, and wherein said means for controlling processes signals from said at least one sensor for ambient environmental conditions, from said at least one sensor for media parameters, and from said at least one sensor for print quality characteristics in a determinatively interactive manner such that commands are sent by said means for controlling to electrophotographic processing subsystems of said apparatus substantially in real time, setting optimal levels for printing the image data on a current media sheet passing through said apparatus.

* * * * *